United States Patent [19]

Beier

[11] 3,989,018

[45] Nov. 2, 1976

[54] EXHAUST GAS RECYCLING APPARATUS

[75] Inventor: Alfred Beier, Hondelage, Germany

[73] Assignee: Volkswagenwerk Aktiengesellschaft, Wolfsburg, Germany

[22] Filed: Jan. 27, 1975

[21] Appl. No.: 544,220

[30] Foreign Application Priority Data

Feb. 15, 1974 Germany ..... 2407179

[52] U.S. Cl. ..... 123/119 A

[51] Int. Cl.[2] ..... F02M 25/00

[58] Field of Search ..... 123/119 A; 74/470; 137/614.14; 251/335

[56] References Cited

UNITED STATES PATENTS

| | | | |
|---|---|---|---|
| 2,526,363 | 10/1950 | Jones | 251/335 R |
| 3,241,394 | 3/1966 | Rubenstein | 74/470 |
| 3,807,375 | 4/1974 | Hertfzlder | 123/119 A |

FOREIGN PATENTS OR APPLICATIONS

| | | | |
|---|---|---|---|
| 2,034,930 | 11/1971 | Germany | 123/119 A |

*Primary Examiner*—Ronald H. Lazarus
*Attorney, Agent, or Firm*—Brumbaugh, Graves, Donohue & Raymond

[57] ABSTRACT

Apparatus for recycling gas exhausted from an internal combustion engine includes a return conduit communicating with the intake manifold of the engine and a return valve for controlling the quantity of exhaust gas recycled to the intake manifold. A connecting linkage operatively coupling the return valve to the engine throttle valve insures that the return valve operates in accordance with the relative position of the throttle valve. The return valve includes a valve housing interposed between and communicating with the return conduit and the intake manifold and a valve body movable in the housing so as to vary the cross-sectional flow area available in the housing. A valve stem mounts the valve body at one end and is operatively coupled at its other end to the connecting linkage. In accordance with the invention, an elastic diaphragm extends radially outwardly from the valve stem of the return valve to the interior surface of the valve housing. The diaphragm seals the portion of the interior of the valve through which exhaust gas flows against leakage of exhaust gas between the valve stem and the valve housing. In a preferred embodiment of the invention, the connecting linkage is adjustable to permit convenient adjustment of the operation of the return valve relative to operation of the throttle valve.

8 Claims, 1 Drawing Figure

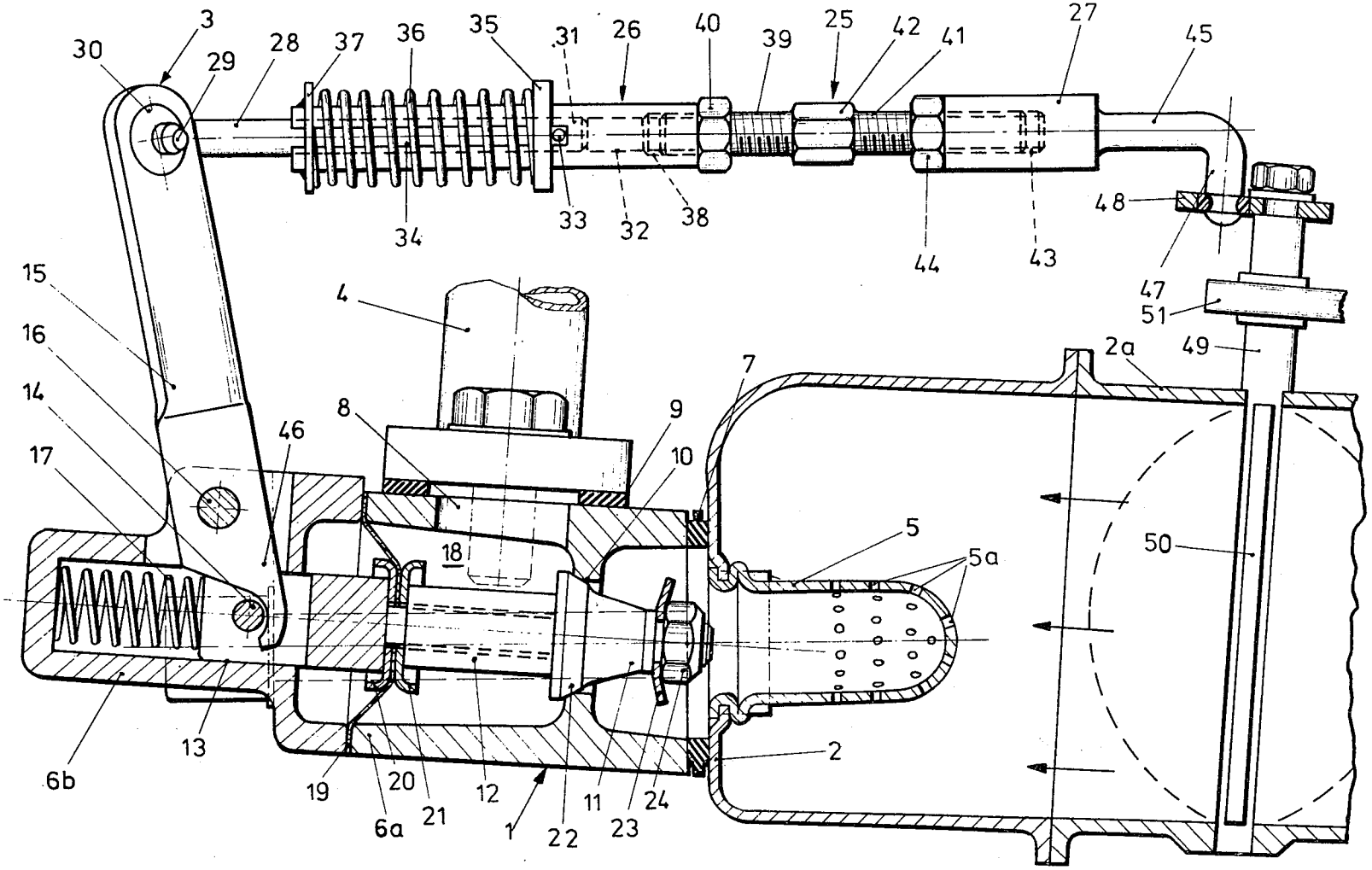
45
27
41
42
25
39
40
26
31
35
36
37
28
3
29
30
48
47
51
49
43
44
38
32
33
34
2a
50
5a
5
7
9
10
4
8
18
46
15
16
14
17
2
24
23
11
22
1
12
21
20
6a
19
13
6b

EXHAUST GAS RECYCLING APPARATUS

BACKGROUND OF THE INVENTION

To reduce the quantity of atmospheric pollutants in exhaust gases from internal combustion engines and to meet the increasingly stringent regulations regarding the content of such gases, various methods and associated apparatus have been developed to purify exhaust gases. One such method is to recycle a portion of the exhaust gas from an engine back through the engine. By returning the exhaust gases, which consist essentially of inert gases, to the engine intake and mixing the returned exhaust gases with the air and/or air-fuel mixture being taken in by the engine, the nitric oxide content of the gases ultimately exhausted from the engine is decreased. In particular, the recycling of exhaust gases decreases the peak combustion temperatures in the combustion chambers of the engine so that the emission of nitric oxides, which is a function of such combustion temperatures, can be significantly reduced.

Particular apparatus used to practice the recycling method of emission control is described and discussed in paper No. 720123 published by the Society of Automotive Engineers, Inc. (SAE). The paper is entitled "Exhaust Recirculation and Spark Control — A Speed Governed and Vacuum Modulated System" and is authored by E. J. Martin and D. R. Vance. Each version of the apparatus described in SAE paper No. 720123 includes a conduit extending from an engine exhaust line to a point in the engine air/fuel intake system. A valve in the conduit regulates the flow of exhaust gas from the exhaust line to the air/fuel intake system. The regulating valve is either a flap type or a poppet type valve.

Regulating valves have also been proposed that utilize rotatable, perforated plates, rather than flaps or axially movable valve bodies, as exemplified by the valves described and illustrated in copending, commonly owned application Ser. No. 429,625, filed Dec. 28, 1973.

Apparatus for practicing the recycling method of emission control is also described and illustrated in German Offenlegungsschrift No. 2,002,164 and in corresponding U.S. Pat. No. 3,675,633 issued to Nakajima et al. In the apparatus of the Nakajima patent, a recirculation control valve for controlling the quantity of exhaust gas being recycled through the engine has a construction similar to a conventional cam operated valve for the intake and exhaust of a cylinder of an internal combustion engine. The disc-shaped valve body of the recirculation valve is mounted on a valve stem that is moved by a rotatable cam. The cam is connected by a tie rod linkage to the throttle valve for the engine.

Since the stem of the Nakajima et al. valve must pass through the valve housing to engage the cam, the valve must be sealed against exhaust gas leakage along the interface between the valve stem and the inner surfaces of the valve housing. If, as happens during normal operations, the valve stem and the guide slot that receives the valve stem in the valve housing are exposed directly to hot exhaust gases, a layer of soot and other contaminants carried by the exhaust gases is rapidly deposited on the surfaces of the valve stem and the guide slot. Thus, after a short period of operation, the valve will become sluggish in operation and may break down completely.

It has also been found, with recycling valves of the type illustrated in the Nakajima et al. patent, that it is very difficult to adjust precisely the timing of the opening and closing of the valve, an adjustment which is of utmost importance for proper functioning of the recycling system. Another disadvantage is that if the valve body or the valve stem sticks in the valve housing due to icing, for example, proper operation of the throttle valve is also blocked, or at least made more difficult, because of the connecting linkage between the throttle valve and the recycling valve.

SUMMARY OF THE INVENTION

The present invention is directed to apparatus for exhaust gas recycling which includes an adequate seal for the valve stem of a recycling or return valve, has a relatively simple construction, has an adjustable connecting linkage between the throttle valve and the recycling valve, and permits the throttle valve to work independently of any blockage or binding occurring in the recycling valve. In accordance with the invention, the apparatus has a recycling valve fitted with an elastic diaphragm extending radially outwardly from a valve stem that mounts a valve body to the interior surfaces of the valve housing. The diaphragm, which is fabricated of heat-resistant elastic material, seals the portion of the interior of the valve housing through which the exhaust gas flows against leakage of exhaust gas around the valve stem. The diaphragm also separates the portion of the housing which contains the gas flow from the portion of the housing that defines a guide for the valve stem so as to prevent soot and dirt carried by the exhaust gas from gumming-up or otherwise obstructing the valve stem and/or the guide for the valve stem. The recycling valve of apparatus constructed according to the invention can thus function accurately and easily even after a long period of operation.

In a preferred embodiment of the invention, the valve body of the recycling or return valve has a portion of generally conical shape and is coaxial with an opening within the valve housing. The outer surface of the valve body is configured relative to the opening so as to ensure a desired variation in the available cross-sectional flow area of the opening as the valve body moves axially within the opening. At each end of the valve body, a closure ensures that the opening is completely closed when the valve body is at either one of its extreme axial positions. The closure at one end is formed by widening the base of the conical portion of the valve body to define a valve seat. At the other end of the valve body, a special plate element is releasably coupled adjacent the apex of the conical portion of the valve body. With a recycling valve thus constructed, axial movement of the valve body adjusts the annular cross-sectional flow area through the valve housing and the quantity of exhaust gas to be recycled as determined by the position of the throttle valve. Since complete closures are provided for each of the extreme axial positions of the valve body, no exhaust gas will be recycled either when the throttle valve is in a full load position or when the throttle valve is only slightly open.

To permit adjustment of the operation of the recycling valve, the connecting linkage includes a member having a variable and adjustable length. The adjustable length member comprises two longitudinally spaced apart end elements having opposed threaded bores and a bolt member located between the end elements. Opposite ends of the bolt member are threaded in opposite directions and each end of the bolt member is screwed into an adjacent threaded bore of one of the end members. Accordingly, rotating the bolt member relative to the end members will cause the end members either to move towards each other or to move away from each other so as to adjust the length of the member and the connecting linkage. To ensure that the bolt member is not screwed into either of the end members farther than is desired, nuts may be screwed on to each end of the bolt member ahead of the end elements. The adjustable length member facilitates simple and precise regulation of the timing of the opening and closing of the exhaust gas recycling valve to achieve the optimum effect on the formation of nitric oxides in the internal combustion engine.

In order to permit the throttle valve, to which the connecting linkage from the recycling valve is connected, to operate despite blockage of the recycling valve, a spring is included in the connecting linkage. If the recycling valve is iced over or otherwise stuck, the spring affords an elastic coupling between the throttle valve and the recycling valve so that the throttle valve can move despite the immovability of the valve body in the recycling valve. The spring also permits the recycling valve to be adjusted so that recycling of exhaust gas is stopped long before the throttle valve reaches its full load position. Recycling exhaust gas can thus be prevented throughout the upper load ranges of the engine to avoid power losses which otherwise result from supplying exhaust gas to the cylinder intakes.

In one configuration, the connecting linkage includes two coaxial shaft members having adjacent ends telescopically received one in the other. The spring encircles both shaft members and is coupled to the adjacent ends of the shaft members. When the shaft members are moved relative to and axially away from each other, the spring is compressed between the adjacent ends.

BRIEF DESCRIPTION OF THE DRAWING

For a better understanding of the invention, reference may be made to the following description of an exemplary embodiment, taken in conjunction with the accompanying drawing which is a view, partly in section, of exhaust gas recycling apparatus according to the invention.

DESCRIPTION OF AN EMBODIMENT

The drawing illustrates, in transverse section, an intake manifold 2 of an internal combustion engine. The manifold 2 is attached to and communicates with a recycling or return valve, generally designated 1, for controlling a flow of gas from the exhaust of the engine back to the intake manifold. The return valve 1, in turn, is coupled to and communicates with a return line or conduit 4 that is connected to the exhaust of the engine. At the point where the return valve 1 communicates with the intake manifold 2, the valve is also connected to a manifold 5 which introduces the recycled exhaust gas into the intake manifold through openings 5*a*. The manifold 5, which may be located either upstream or downstream from the point where fuel is mixed with incoming air for the engine cylinders, improves the mixing of the exhaust gas with the clean air and/or the air-fuel mixture flowing through the intake manifold 2. The return valve 1 is operated in accordance with the various positions of a throttle valve 50 for the engine through a connecting linkage, generally designated 3.

The return valve 1 includes a housing formed of two parts 6*a* and 6*b*, one of which (6*a*) is attached to the intake manifold 2 with a seal member 7 interposed between the end of the housing part and the wall of the intake manifold. The housing part 6*a* has a central bore that communicates with the interior of the intake manifold 2 through the exhaust gas mixing manifold 5. Along the side of the housing part 6*a*, the return conduit 4 communicates with the interior of the housing part through a bore 8 that extends radially of the central bore in the housing part. A fitting bolted to the side of the housing part 6*a* secures the return conduit 4 to the housing part, and a seal member 9 is interposed between the wall of the housing part and the fitting to prevent leakage of exhaust gas at the connection.

Within the central bore of the housing part 6*a*, between the radial or lateral bore 8 and the end of the housing part communicating with the intake manifold 2, the cross-sectional area of the central bore is diminished to provide a restricted passage opening 10 through which all exhaust gas must flow to reach the exhaust gas manifold 5. The available cross-sectional flow area of the opening 10 is controlled by the movement of a valve body 11 mounted on one end of a valve stem 12. The valve stem 12 is coaxial with the central bore of the housing part 6*a* and is received at its end away from the valve body 11 in a guide slot 13 formed in the second housing part 6*b*. Movement of the valve body 11 relative to the opening 10 is achieved through the connecting linkage 3, which is coupled to the valve stem 12, as will be described hereinafter. To seal the interior of the valve housing against leakage of exhaust gas along the guide slot 13 around the valve stem 12, an elastic, heat-resistant diaphragm 19 extends radially outwardly on all sides from the valve stem 13 to the inner walls of the housing. The radially outer edge of the diaphragm 19 is captured in the joint between the two parts 6*a* and 6*b* of the housing, while the radially inner edge of the diaphragm 19 is held on the valve stem 12 between two metal plates 20 and 21.

The valve body 11 has a portion of generally conical shape and has an outer surface that is configured relative to the cross-sectional area of the opening 10 so that each selected position of the valve body 11 relative to the opening affords a desired cross-sectional flow area available for exhaust gas. Thus, since the position of the valve body 11 is dependent upon the angular position of the throttle valve 50, the quantity of exhaust gas recirculated through the valve 1 will be controlled in accordance with the setting of the throttle valve.

The position of the valve body 11 illustrated in the drawing is a closed or terminal position, which corresponds to the closed position of the throttle valve. In the illustrated position, the base 22 of the conical portion of the valve body 11, which defines a valve seat, has completely closed the opening 10. A closure plate 23 is mounted on the valve stem 12 adjacent the apex of the conical portion of the valve body 11 and is held in place by a nut 24. The plate 23 effectively closes off the passage 10 when the valve body 11 is in its other terminal position (i.e. when the throttle valve is at or adjacent its full throttle position).

The connecting linkage 3 that transmits movement of the throttle valve 50 to the return valve 1 includes a lever 15 pivoting about a fixed rod or fulcrum 16. A hook 46 at one end of the lever 15 engages a cross bolt 14 protruding from the end of the valve stem 12 in the guide slot 13. As the lever 15 is pivoted about the fulcrum 16, the hook-shaped end 46 draws the valve stem 12 to the left, as viewed in the drawing, against the biasing action of a spring 17 interposed between the end of the valve stem 12 and an interior wall surface of the housing part *6b*.

The other end of the lever 15 mounts an annular plastic bushing 30 that is engaged by the hook-shaped end 29 of a shaft 28. The other end 31 of the shaft 28 is telescopically received in a longitudinal bore 32 of a sleeve-like shaft 26. A transverse or cross bolt 33 projects radially from the end 31 of the shaft 28 and through a longitudinal slot 34 in the sleeve-like shaft 26 to permit telescopic movement of the shaft 28 relative to the sleeve-like shaft 26. Welded to the end of the sleeve 26 closest to the hook-shaped end 29 of the shaft 28 is a retaining plate or ring 37. A coil spring 36 encircles both the sleeve 26 and the shaft 28. One end of the spring 36 is engaged by the securing ring 37 and the other end of the spring 36 is engaged by an annular disc 35. The disc 35 is slidable along the sleeve 26 between the fixed ring 37 and the cross bolt 33 projecting from the shaft 28 through the longitudinal slot 34. Viewed as a whole, the portion of the linkage 3 described above provides an elastic coupling of the shaft 28 to the sleeve 26. Thus, if the sleeve 26 is pulled in a direction away from the shaft 28 and the movement is resisted by the shaft 28, due to the valve body 11 being stuck, for example, the spring 36 is compressed between the fixed ring 37 and the displaceable ring 35 and the sleeve 26 moves relative to the shaft 28.

The end of the sleeve 26 opposite the securing ring 37 has a longitudinal threaded bore 38. Screwed into the threaded bore 38 is a correspondingly threaded end 39 of a bolt member 25 having two threaded ends 39 and 41 and a central portion 42 that is hexagonal in shape so as to be engagable by a wrench or similar tool. The opposite end 41 of the bolt member 25 is screwed into a correspondingly threaded bore 43 of a sleeve member 27. The end 39 of the bolt member 25 is held in position by nut 40, just as the threaded end 41 is held in position by a nut 44. The end of the sleeve member 27 opposite the threaded bore 43 is joined to a rod 45 having a hook-shaped end 47. The hook 47 eccentrically engages a cam plate 48 mounted on an end of a shaft 49 that carries the disc-shaped throttle valve 50 and is journaled in a support *2a*. Thus, as the throttle valve 50 opens, the movement is transmitted through the plate 48 and the connecting linkage 3 (moving the linkage to the right as viewed in the drawing) to open the valve 1. Opening of the same throttle valve 50 is accomplished by pressing down the accelerator pedal (not shown), which is connected to the plate 51 on the shaft 49 by a conventional linkage (not shown).

The precise moment at which the valve 1 will open to permit exhaust gas to recycle can be adjusted precisely by adjusting the length of the connecting linkage 3. Such an adjustment is achieved by rotating the bolt member 25 with a wrench or similar tool. The opposite ends 39 and 41 of the bolt member 25 have opposite threads, i.e., if the end 39 has a left-hand thread, then the end 41 has a right-hand thread, so that by turning the central portion 42, the member defined by the three components 25, 26 and 27, and thus the entire linkage 3, can be shortened or lengthened, as desired. (Prior to shortening the member, the nuts 40 and 44 must be loosened and moved).

Adjusting the length of the connecting linkage 3 between the hook shaped member 47 and the hook shaped member 29 will vary the point, relative to movement of the throttle valve 50, at which the hook-shaped end 46 of the lever 15 engages the cross bolt 14 of the valve stem 12 and displaces the valve body 11. It has been found that for proper operation of the valve 1, the connecting linkage 3 should be adjusted so that the valve body 11 starts to open the passage opening 10 at a throttle valve opening angle of from 0° (closed) to 10°. As the throttle continues to swing beyond the opening position of the return valve 1, the opening 10 is increasingly opened up in conformity with the tapering outer contour of the valve body 11. Depending upon the setting of the closure plate 23, either a long or a short time before the throttle valve attains a full load position (shown in phantom in the drawing), the closure plate will be applied against the side of the opening 10 so as to close the opening. By proper arrangement of the plate 23 and contouring of the outer surface of the valve body 11, the various possible cross-sectional flow areas of the passage 10 can be adjusted to correspond with any desired throttle valve positions. The closure plate 23 can also be replaced with a second conical portion of the valve body, which would taper in a direction opposite that in which the existing portion of the valve body 11 tapers.

In order for the closure plate 23 to be capable of closing the passage 10 before the throttle valve 50 achieves a full load position, without blocking the continued movement of the throttle valve, the elastic coupling afforded by the shaft 28, the sleeve 26 and the spring 36 must be used. When the closure plate 23 contacts the edge of the passage opening 10, so that the valve body 11 cannot be displaced farther with additional movement of the throttle valve 50, the shaft 28 is effectively held stationary while the sleeve 26 continues to move with the throttle valve and the spring 36 is compressed. The compression of the spring 36 permits the throttle valve 50 to continue to open while the valve 1 remains closed. In a similar manner, the spring 36 can also facilitate continued movement of the throttle valve 50 if the valve body 11 becomes stuck in the valve housing because of icing, for example, or because the valve stem 12 has jammed in the guide slot 13. In every instance, the spring 36 permits the throttle valve 50 to continue to operate, although perhaps with somewhat more difficulty, and thereby facilitates continued operation of the engine.

It will be understood that the embodiment of the invention described above is merely exemplary and that persons skilled in the art may make many variations and modifications without departing from the spirit and scope of the invention. All such modifications and variations are intended to be within the scope of the invention as defined in the appended claims.

I claim:

1. An apparatus for recycling gas exhausted from an internal combustion engine, said apparatus including (a) a return conduit communicating with an intake manifold of the engine, (b) a return valve for controlling the quantity of exhaust gas recycled to the intake manifold, having:

i. a valve housing interposed between and communicating with the return conduit and the intake manifold, the interior surfaces of said valve housing defining a gas flow portion and a valve stem mounting portion, ii. a valve body movable in the gas flow portion of the valve housing so as to vary a cross-sectional flow area available in the valve housing.

iii. a valve stem mounting the valve body, and iv. means in the valve stem mounting portion of the valve housing for movably supporting and guiding the valve stem, wherein the valve body is mounted toward one end of the valve stem and a portion of the valve stem opposite the one end is received in the supporting and guiding means formed in the valve stem mounting portion of the valve housing, and (c) a connecting linkage operatively coupling the valve stem of the return valve to a throttle valve for the engine so that the return valve operates in accordance with relative positions of the throttle valve, the improvement comprising elastic diaphragm means extending radially outward from the valve stem to interior surfaces of the valve housing, said diaphragm means being positioned to separate the valve stem mounting portion of the valve housing from the gas flow portion, and to seal and isolate entirely the valve stem supporting and guiding means against leakage or contamination of exhaust gas into the area of the valve stem and the supporting and guiding means.

2. The improvement of claim 1, wherein the valve body has a portion of generally conical shape and is coaxial with an opening within the valve housing, the outer surface of the valve body being configured relative to the opening so as to ensure a desired variation in the available cross-sectional flow area of the opening as the valve body moves axially within the opening, the valve body also having closure means at each end for closing the opening when the valve body is in a selected terminal position relative to the opening.

3. The improvement of claim 2, wherein the closure means include a widened, conical base of the conical portion of the valve body and a plate member mounted adjacent the apex of the conical portion of the valve body.

4. The improvement of claim 1, wherein the connecting linkage includes a member having a variable and adjustable length.

5. The improvement of claim 4, wherein the adjustable-length member includes (a) two longitudinally spaced-apart end elements having opposed threaded bores and (b) a bolt member located between the end elements and having opposite ends threaded in opposite directions, the opposite threaded ends of the bolt member being screwed into adjacent ones of the opposed threaded bores.

6. The improvement of claim 5, wherein the adjustable-length member also includes a nut threaded on each end of the bolt member to limit the extent to which the corresponding end of the bolt can be screwed into the adjacent threaded bore.

7. The improvement of claim 1, wherein the connecting linkage includes a spring.

8. The improvement of claim 7, wherein the connecting linkage also includes two coaxial shaft members, one end of one shaft member being telescopically received in one end of the other shaft member, each of said one ends of the shaft members having connected to it means for engaging an end of the spring, the spring encircling at least parts of both shaft members and being located between said one ends of the shaft members such that when the other ends of the shaft members are moved axially away from each other, the spring is compressed.

* * * * *